US009157241B2

(12) United States Patent
Boyadjian et al.

(10) Patent No.: US 9,157,241 B2
(45) Date of Patent: Oct. 13, 2015

(54) TILE FOR A COVERING WITH ENHANCED ACOUSTIC PROPERTIES

(75) Inventors: Pierre Boyadjian, Chambery (FR); David Fournier, Breteuil (FR); Serge Rimlinger, Seyssinet Pariset (FR); Michele Curt, Peronnas (FR); Cedric Chaveyriat, Ceyzeriat (FR)

(73) Assignee: SAINT-GOBAIN WEBER FRANCE, Servon (FR)

( * ) Notice: Subject to any disclaimer, the term of this patent is extended or adjusted under 35 U.S.C. 154(b) by 1029 days.

(21) Appl. No.: 12/507,209

(22) Filed: Jul. 22, 2009

(65) Prior Publication Data

US 2010/0018133 A1 Jan. 28, 2010

(30) Foreign Application Priority Data

Jul. 24, 2008 (FR) ..... 08 55087

(51) Int. Cl.

*E04F 15/20* (2006.01)
*E04F 15/08* (2006.01)
*E04F 15/18* (2006.01)

(52) U.S. Cl.

CPC ..... *E04F 15/085* (2013.01); *E04F 15/181* (2013.01); *E04F 15/20* (2013.01); *E04F 2290/043* (2013.01)

(58) Field of Classification Search

CPC ..... E04F 15/08; E04F 15/181; E04F 15/20; E04F 2290/043
USPC ..... 52/144, 145, 403.1, 506.01; 181/285, 181/286, 290
See application file for complete search history.

(56) References Cited

U.S. PATENT DOCUMENTS

| | | | | | |
|---|---|---|---|---|---|
| 3,424,270 | A * | 1/1969 | Hartman et al. | ..... | 181/290 |
| 3,817,012 | A * | 6/1974 | Wack et al. | ..... | 52/315 |
| 3,988,187 | A * | 10/1976 | Witt et al. | ..... | 156/71 |
| 5,362,560 | A * | 11/1994 | Ehrhart et al. | ..... | 428/343 |
| 6,073,408 | A * | 6/2000 | Winer et al. | ..... | 52/385 |
| 2004/0137248 | A1 * | 7/2004 | Elsasser | ..... | 428/476.3 |
| 2005/0288429 | A1 * | 12/2005 | Rymer et al. | ..... | 524/557 |
| 2006/0008648 | A1 * | 1/2006 | Bennison et al. | ..... | 428/411.1 |
| 2006/0162269 | A1 * | 7/2006 | Pacione et al. | ..... | 52/403.1 |

FOREIGN PATENT DOCUMENTS

| | | | | |
|---|---|---|---|---|
| EP | 0278584 | * 2/1988 | ..... | E04F 15/02 |
| FR | 2570116 | * 3/1986 | ..... | E04F 15/08 |
| WO | WO 2007043955 | * 4/2007 | ..... | E04F 15/20 |

OTHER PUBLICATIONS

LDPE Properties from http://poly.chemnetbase.com/entry.do?method=view&id=1211&si=POLY.*
Polypropylene Properties from http://poly.chemnetbase.com/entry.do?id=1165&method=view&si=POLY.*
Polyvinyl butyral Properties from http://poly.chemnetbase.com/entry.do?id=3700&method=view&si=POLY.*
Vaceva Quiet Product sheet from https://team.solutia.com/sites/msds/Saflex/7189WEN.PDF.*
Young's Modulus of Concrete from http://www.engineeringtoolbox.com/young-modulus-d_417.html.*

* cited by examiner

*Primary Examiner* — Christine T Cajilig
(74) *Attorney, Agent, or Firm* — Oblon, McClelland, Maier & Neustadt, L.L.P.

(57) ABSTRACT

A tile made of a tile body and, joined to a face thereof, a layer of damping material conferring vibratory energy dissipation properties on the tile.

20 Claims, 1 Drawing Sheet

TILE FOR A COVERING WITH ENHANCED ACOUSTIC PROPERTIES

REFERENCE TO PRIOR APPLICATIONS

This application claims priority to French patent application 08 55087, filed Jul. 24, 2008, incorporated herein by reference.

FIELD OF THE INVENTION

The invention relates to a tile for, e.g., a floor or wall covering, having acoustic enhancement properties. In the context of the present invention, the tile may be based on ceramic such as faience, terracotta, stoneware, a tile of vitreous paste, a marble tile, a reconstituted stone tile, a tile of rigid composite material, etc., which is preferably such that one can walk on the tile when it constitutes a floor covering. The invention also relates to the covering obtained by the combination of several tiles having acoustic enhancement properties.

Additional advantages and other features of the present invention will be set forth in part in the description that follows and in part will become apparent to those having ordinary skill in the art upon examination of the following or may be learned from the practice of the present invention. The advantages of the present invention may be realized and obtained as particularly pointed out in the appended claims. As will be realized, the present invention is capable of other and different embodiments, and its several details are capable of modifications in various obvious respects, all without departing from the present invention. The description is to be regarded as illustrative in nature, and not as restrictive.

BACKGROUND OF THE INVENTION

In the field of acoustic enhancement, a distinguishment is mainly drawn between enhancement by acoustic insulation and enhancement by acoustic correction.

Acoustic insulation reduces the transmission of sound from one room to another, whether via the floor, the ceiling or the side walls. Acoustic insulation reduces sound of mechanical origin, such as impact or collision sound, and also airborne sound, as well as that generated by persons speaking or hi-fi systems.

Acoustic correction decreases the sound in the room where the acoustic source is located. Acoustic correction applies to sound of mechanical origin and airborne sound. In the case of sound of mechanical origin on a floor, this is referred to as acoustic correction of walking sound.

For several years, to provide acoustic insulation in particular against impact sound, floors have been provided with acoustic underlayers on which the tile type of floor covering is laid. It is known to use cork tiles for this purpose, or rubber based underlayers, which are in the form of tiles or consist of a leveling screed, or even underlayers based on generally synthetic fibers.

Patent application FR 2 361 515 proposes bonding polystyrene plates on the floor and then pouring a mortar screed comprising a mixture of cement, sand and rubber. Once the screed is dry, the tiling is placed on top of it.

Patent EP 0 413 626 B1 discloses a soundproofing tile having a hard surface in comparison with the covering to be laid such as tiling, and having an elastic reaction support on the opposite side. It comprises a dense and flexible layer of supercompressed fibers having a density between 60 and 200 kg/m$^3$ which constitutes the elastic reaction support, and a layer of bitumen reinforced with two thin layers of glass fibers anchored respectively in each of the faces of the bitumen layer to constitute the rigid face of this tile, the rigid layer having a thickness of about 5 to 6 mm with a mass per unit area of about 10 kg/m$^2$.

Document FR 2 693 221 proposes an insulation solution in the form of rolls. This underlayer comprises a main layer which is placed on the covering side and a secondary layer which is arranged on the opposite side, the floor side.

The secondary layer is a material based, for example, on a polymer of the polyvinyl chloride (PVC), polyurethane rubber (PUR), polyethylene (PE), styrene-butadiene rubber (SBR) type, and having a thickness of between 0.1 mm and 5 mm, with a density not exceeding 800 kg/m$^3$.

The main layer of the underlayer serves to provide the mechanical strength of the whole underlayer. Its constituent material is, for example, a synthetic polymer such as polyvinyl chloride (PVC), a polypropylene (PP), polyethylene (PE), or even a bitumen, but it may also be made from materials of natural origin such as wood fibers. This layer is relatively hard on the surface but remains sufficiently flexible to be rolled up so that the underlayer can be provided in the form of rolls.

However, all these acoustic insulation underlayers require specific systems to be installed, time-consuming application methods, and sometimes demand the involvement of professionals, in particular in the preparation of screeds which require knowhow and generate drying times.

In fact, whether for the artisan or the private individual who wants to lay his tiling himself, providing it with an acoustic underlayer, it is always desirable to reduce the laying time and to facilitate the implementation of the assembly.

It is an object of the invention to provide a solution that serves to install the tiling rapidly and simply, while conferring acoustic enhancement properties on the installed covering.

Figure 1:
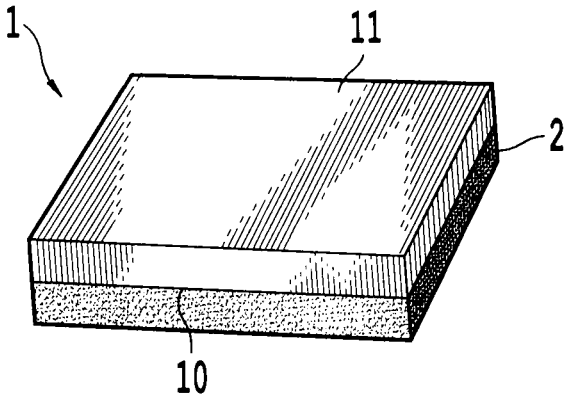
FIG. 1 shows a schematic perspective view of a tile with acoustic insulation properties according to the invention.

The figures are not to scale for ease of reading.

DETAILED DESCRIPTION OF THE PREFERRED EMBODIMENTS

According to the invention, the tile is characterized in that it comprises a tile body and, joined to one of its faces, preferably the one designed to be facing the support to be covered with the tile, a layer of damping material conferring vibratory energy dissipation properties on the tile.

This solution thus proposes an "all-in-one" type of product, the tile to be laid being already provided with damping means.

Above all, this solution confers a reduction of walking sound but also procures insulation against impact sound and airborne sound.

According to one feature, the layer of damping material has, at 20° C., and at a frequency of between 10 Hz and 5000 Hz, a dynamic Young's modulus E' lower than $10^9$ Pa and a loss factor tan δ higher than or equal to 0.08, preferably higher than 0.3. It may be noted that the Young's modulus and loss factor are measured in a manner known per se using a viscoanalyzer.

Furthermore, the inventors have demonstrated that it is preferable for the layer of damping material to be sandwiched between two rigid elements which are the tile body and the support on which the tile is applied, for example a floor or wall, to provide its full damping function by its shear work. This feature is reflected by the impedance break (pronounced discontinuity of the material stiffness) which must exist between the tile and the damping material and also between the damping material and the support. The shear work of the damping layer accordingly serves to dissipate the energy. The stiffness ratio between the damping material, and the tile body ($E'_{material}/E'_{tile}$) should be lower than 0.09, and the stiffness ratio between the damping material and the support) $E'_{material}/E'_{support}$) should also be lower than 0.09.

According to one feature, the layer of damping material comprises, consists essentially of, or consists of one or more viscoelastic polymeric materials, such as bitumen, styrene-acrylic based polymers, polyvinyl butyral, in particular polyvinyl butyral having enhanced acoustic damping properties.

The layer of damping material may be in the form of a sheet or a film or a poured resin, and may comprise one or more damping polymeric materials.

According to another feature, the layer of damping material is joined to the tile body by bonding means of the water adhesive type or by the intrinsic adhesive character of the damping material, its tack being generally present and/or capable of being stimulated, in particular by heating.

The tile body may be constituted of any rigid material, and can be made for example of ceramic, such as faience, terracotta, sandstone, vitreous paste, marble, reconstituted stone, or a rigid composite material. It may have any shape, including square, rectangular, polygonal, etc. Generally preferred is a tile body that presents two opposing large flat surfaces.

The tile is joined to a rigid support, for example of the floor or wall type, by adhesion of the layer of damping material.

Finally, by the combination of a plurality of tiles of the invention, a floor or wall covering can be provided.

FIG. 1 shows a tile 1 with acoustic enhancement properties according to the invention.

The tile comprises a face 10 intended to be facing a rigid support (e.g., floor or wall) on which the tile is intended to be laid, and a tile body with an opposite face 11.

The face 10 comprises a joined layer of damping material 2.

The face 11 of the tile body is based on ceramic for example, or any other common material used for a tiled covering.

The layer 2 of damping material, called damping layer, is preferably characterized at 20° C. and at a frequency of between 10 Hz and 5000 Hz, by a loss factor tan δ at least equal to 0.08, preferably higher than 0.3, and by a Young's modulus E' lower than $10^9$ Pa and preferably between $5\times10^6$ Pa and $10^9$ Pa.

The damping layer comprises, consists essentially of, or consists of one or more viscoelastic damping materials. As damping materials, mention can be made of bitumen, polymers based on styrene-acrylic or butyl, for example polyvinyl butyral (PVB).

A preferred example of a material is polyvinyl butyral with enhanced acoustic damping properties.

As PVB with enhanced acoustic damping properties, mention can be made of the material sold under the trade name Saflex® Vanceva Quiet QC41 by Solutia, which has, at 20° C. and between 10 and 5000 Hz, a loss factor tan δ between 0.4 and 1.1 and a Young's modulus E' between $7.8\times10^6$ Pa and $1.2\times10^8$ Pa, and in particular at 1000 Hz, a loss factor tan δ of 1 and a Young's modulus E' of $5\times10^7$ Pa.

The layer 2 is in the form of a film which is joined to the tile body by compatible bonding means between the material of the layer and that of the tile. By way of example, it is possible to join the acoustic PVB film to the ceramic tile using a conventional water glue.

As an alternative, the layer 2 is in the form of a resin which is poured out when hot onto the tile and of which the material has the necessary qualities of adherence with the tile material. By way of example, it may be a styrene-acrylic based substance.

Whether in the form of resin or film, the layer may comprise a stack of materials.

The layer preferably has a thickness of between 0.2 and 3 mm, preferably between 0.2 and 1 mm.

Figure 2:
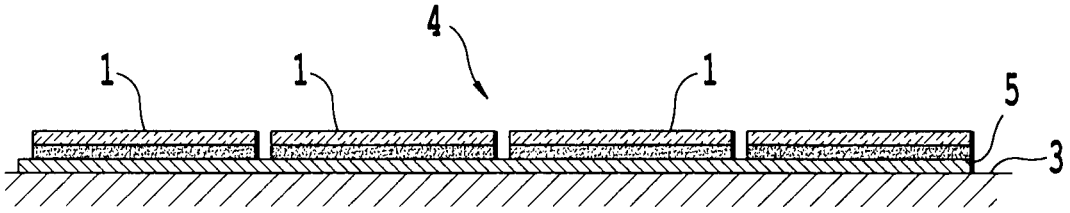
FIG. 2 shows a schematic cross section of a floor covered with tiles according to FIG. 1.

FIG. 2 shows the bonding of a plurality of tiles on a floor 3 which thereby forms a tiled covering 4 with acoustic enhancement properties.

The damping layer serves more particularly to provide an acoustic enhancement with regard to walking sound by reducing the amplitude of the bending waves in the tile generated by impact, and thereby to reduce the acoustic radiation of the tiles and hence the sound within the room.

The inventors have succeeded in demonstrating that this damping function is commensurately more pronounced by the fact that the tile combined with the damping layer is bonded to a rigid support, e.g., the floor or the wall. A sandwich type structure is thereby created between two rigid elements, which serves to shear the intermediate damping layer and dissipate the vibratory energy.

If the tile of the invention is mainly intended to be used directly as such to provide the appropriate acoustic enhancement covering, it is nevertheless possible to consider previously depositing an underlayer having open porosity and having a degree of elasticity, such as underlayers based on fibers, which will be more particularly adapted to insulation against impact sound. However, a rigid element must be inserted between this fibrous underlayer and the damping layer so that the latter can fully perform its role according to the invention.

The bonding of the tile to the support for which it is intended is carried out for example by bonding material 5 compatible with the damping layer 2 and with the support 3. These materials are for example cement, plaster, wood, mineral binder, nonwoven, reinforced or cast synthetic or mineral fibers.

The tile of the invention undeniably has acoustic enhancement properties.

Comparative tests were conducted between a sample of simple tiles without a damping layer (example 1), and two samples of tiles provided with a damping polymeric layer (examples 2 and 3). The samples were bonded to a cement support.

These tests were conducted by the measurement method described in document ISO PAS 16940 by successively selecting during the post-treatment, the resonance frequency closest to 200 Hz, 1000 Hz and 3150 Hz, to obtain the modal damping coefficients of the structure at 20° C. and respectively at 200 Hz, 1000 Hz and 3150 Hz. Each measured sample consisted of a 5 mm thick cement support, a conventional tiling adhesive, and three ceramic tiles joined by conventional tile joints on an area of 0.12 $m^2$.

The results obtained for the three examples are summarized below in Table 1.

Example 1 (Ex. 1) relates to a DESVRES tile of fine glazed stoneware, measuring 200 mm×200 mm×7.5 mm, without damping layer.

Example 2 (Ex. 2) relates to the same ceramic tile as example 1 and is provided with a conventional polyvinyl butyral film, here the film with the trade name Saflex® RC41 produced by SOLUTIA, which has, at 20° C. and between 10 and 5000 Hz, a loss factor tan δ of between 0.1 and 0.45 and a Young's modulus E' between $2.5\times10^8$ Pa and $7\times10^8$ Pa, and in particular a loss factor tan δ of 0.2 and a Young's modulus E' of $5.9\times10^8$ Pa.

Example 3 (Ex. 3) relates to the same ceramic tile as example 1 and is provided with a polyvinyl butyral film having enhanced acoustic damping properties with the trade name Saflex® Vanceva Quiet QC41 produced by SOLUTIA, which has, at 20° C. and between 10 and 5000 Hz, a loss factor tan δ of between 0.4 and 1.1 and a Young's modulus E' between $7.8\times10^6$ Pa and $1.2\times10^8$ Pa, and in particular at 1000 Hz, a loss factor tan δ of 1 and a Young's modulus E' of $5\times10^7$ Pa.

Table 1 below summarizes the modal damping coefficient of each example, at 20° C. and at several frequencies.

| | Ex. 1 | Ex. 2 | Ex. 3 |
|---|---|---|---|
| Modal damping coefficient at 200 Hz | 0.02 | 0.07 | 0.07 |
| Modal damping coefficient at 1000 Hz | 0.02 | 0.14 | 0.14 |
| Modal damping coefficient at 3150 Hz | 0.03 | 0.19 | 0.3 |

The significant increase in the modal damping coefficient reflects the real acoustic enhancement performance that a tile of the invention can provide.

The modal damping coefficient at 200 Hz is an indicator of acoustic performance at low frequencies. The increase in this damping coefficient from 0.02 to 0.07 reflects a greater energy dissipation in the structure and hence a significantly lower radiated sound. This situation is even more pronounced at the medium frequencies according to the increase in the modal damping coefficient at 1000 Hz, and at the high frequencies according to the increase in the modal damping coefficient at 3150 Hz.

At the high and medium frequencies, it can be observed that the modal damping coefficient is multiplied by 5 between a conventional covering and a covering provided with a damping layer according to the invention, or even multiplied by 10 by using a damping material that is even further enhanced in terms of its acoustic performance.

To supplement these measurements, at 1000 Hz and at 20° C., the stiffness ratio between the acoustic PVB Saflex® Vanceva Quiet QC41 (Example 3) and the ceramic tile $E'_{PVBac}/E'_{tile}$ is 0.001, hence lower than 0.09 according to the invention. At 1000 Hz and at 20° C., the stiffness ratio between the acoustic PVB Saflex® Vanceva Quiet QC41 and the cement, $E'_{PVBac}/E'_{support}$ is 0.004, hence lower than 0.09.

Such a tile further has a definite advantage in the speed of laying a covering designed to provide acoustic enhancement properties. By providing the tile incorporating the damping layer in the form of a complete kit, the invention makes it possible, by the supply of a plurality of tiles and their direct bonding to the support, to produce the desired covering simply and rapidly.

The above written description of the invention provides a manner and process of making and using it such that any person skilled in this art is enabled to make and use the same, this enablement being provided in particular for the subject matter of the appended claims, which make up a part of the original description.

As used herein, the words "a" and "an" and the like carry the meaning of "one or more."

The phrases "selected from the group consisting of," "chosen from," and the like include mixtures of the specified materials. Terms such as "contain(s)" and the like are open terms meaning 'including at least' unless otherwise specifically noted.

All references, patents, applications, tests, standards, documents, publications, brochures, texts, articles, etc. mentioned herein are incorporated herein by reference. Where a numerical limit or range is stated, the endpoints are included. Also, all values and subranges within a numerical limit or range are specifically included as if explicitly written out.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein. In this regard, certain embodiments within the invention may not show every benefit of the invention, considered broadly.

The invention claimed is:

1. A tile comprising a tile body and, joined to a face thereof, a layer of damping material conferring vibratory energy dissipation properties on the tile, wherein the layer of damping material has, at 20° C., between 10 Hz and 5000 Hz, a loss factor tan δ at least equal to 0.08, and a dynamic Young's modulus E' of $5\times10^6$ Pa to $10^9$ Pa.

2. The tile as claimed in claim 1, wherein the tile is joined to a support and wherein the layer of damping material, the tile body and the support have a Young's modulus E'material, E'tile, and E' support which are such that the ratio E'material/E'tile is lower than 0.09 and the ratio E'material/E'support is lower than 0.09.

3. The tile as claimed in claim 1, wherein the layer of damping material comprises of one or more materials selected from the group consisting of bitumen, styrene-acrylic based polymers, and polyvinyl butyral.

4. The tile as claimed in claim 1, wherein the layer of damping material comprises a sheet or a film, or a poured resin, of one or more damping polymeric materials.

5. The tile as claimed in claim 1, wherein the layer of damping material is joined to the tile by a water-based adhesive bonding material.

6. The tile as claimed in claim 1, wherein the layer of damping material has an intrinsic adhesive character and is joined to the tile thereby.

7. The tile as claimed in claim 1, wherein a face of the tile body opposite the face comprising the layer of damping material is made from ceramic, marble, reconstituted stone, or a rigid composite material.

8. The tile as claimed in claim 1, further comprising a rigid support which is adhered to the layer of damping material.

9. A covering comprising a plurality of tiles as claimed in claim 1.

10. A covering comprising a plurality of tiles as claimed in claim 8.

11. A covering as claimed in claim 10, wherein the rigid support is a wall.

12. A covering as claimed in claim 10, wherein the rigid support is a floor.

13. The tile as claimed in claim 1, wherein the layer of damping material comprises polyvinyl butyral.

14. The tile as claimed in claim 1, wherein the layer of damping material comprises of one or more materials selected from the group consisting of bitumen and styrene-acrylic based polymers.

15. The tile as claimed in claim 2, further comprising a rigid support which is adhered to the layer of damping material.

16. The tile as claimed in claim 1, wherein the layer of damping material has, at 20° C., between 10 Hz and 5000 Hz, a loss factor tan δ of between 0.1 and 0.45, and a dynamic Young's modulus E' of $2.5\times10^8$ Pa to $7\times10^8$ Pa.

17. The tile as claimed in claim 1, wherein the layer of damping material has, at 20° C., between 10 Hz and 5000 Hz, a loss factor tan δ of between 0.4 and 1.1, and a dynamic Young's modulus E' of $7.8\times10^6$ Pa to $1.2\times10^8$ Pa.

18. A covering comprising a plurality of tiles as claimed in claim 15.

19. A covering as claimed in claim 18, wherein the rigid support is a wall.

20. A covering as claimed in claim 18, wherein the rigid support is a floor.

* * * * *